US005510673A

United States Patent [19]

Wodecki et al.

[11] Patent Number: 5,510,673

[45] Date of Patent: Apr. 23, 1996

[54] SHOCK RESISTANT CASCADED MICROCHANNEL PLATE ASSEMBLIES AND METHODS OF USE

[75] Inventors: Norman D. Wodecki; Charles B. Johnson, both of Phoenix; Kevin D. Wheeler, Scottsdale, all of Ariz.

[73] Assignee: Litton Systems, Inc., Woodland Hills, Calif.

[21] Appl. No.: 282,813

[22] Filed: Jul. 29, 1994

[51] Int. Cl.[6] ..... H01J 31/50

[52] U.S. Cl. ..... 313/524; 313/377; 250/214 VT

[58] Field of Search ..... 313/372, 524, 313/528, 530, 532, 538, 539, 103 R, 103 CM, 105 CM, 383, 390; 250/214 VT

[56] References Cited

U.S. PATENT DOCUMENTS

| | | | |
|---|---|---|---|
| 3,675,028 | 7/1972 | Grant | 313/105 CM |
| 4,039,877 | 8/1977 | Wimmer | 313/383 |
| 4,511,822 | 4/1985 | Washington et al. | 313/105 CM |
| 4,737,013 | 4/1988 | Wilcox | 350/96.27 |
| 5,111,035 | 5/1992 | De Luca | 313/532 |
| 5,349,177 | 9/1994 | Thomas et al. | 313/528 |
| 5,404,072 | 4/1995 | Flanary et al. | 313/524 |
| 5,408,088 | 4/1995 | Chapman et al. | 313/524 |

*Primary Examiner*—Sandra L. O'Shea
*Assistant Examiner*—Vip Patel
*Attorney, Agent, or Firm*—Poms, Smith, Lande & Rose

[57] ABSTRACT

Shock resistant microchannel plate assemblies incorporating stacked or cascaded microchannel plates, and to methods of their use are disclosed. High-output amplification tubes of the photomultiplier type, or of the image intensifier type, having a plurality of sequentially arranged, or cascaded, electron multiplier microchannel plates are also disclosed. More particularly the present invention relates to a high output photomultiplier tube or image tube having cascaded microchannel plates radially constrained by an annular insulating ring. In another aspect of the present invention image intensifier tubes or photomultiplier tubes may include a tapered ceramic high voltage stand-off. Moreover, a method of making such tubes is also disclosed.

31 Claims, 3 Drawing Sheets

FIG. 1.
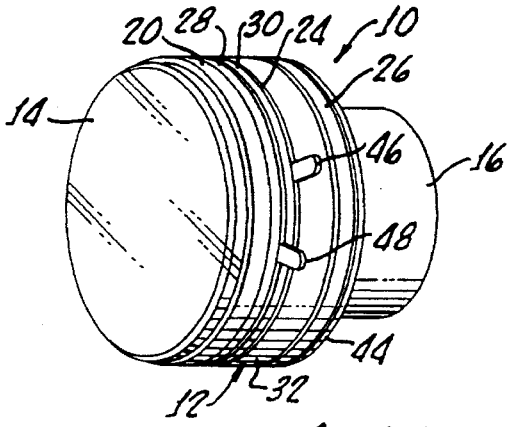
FIG. 2.
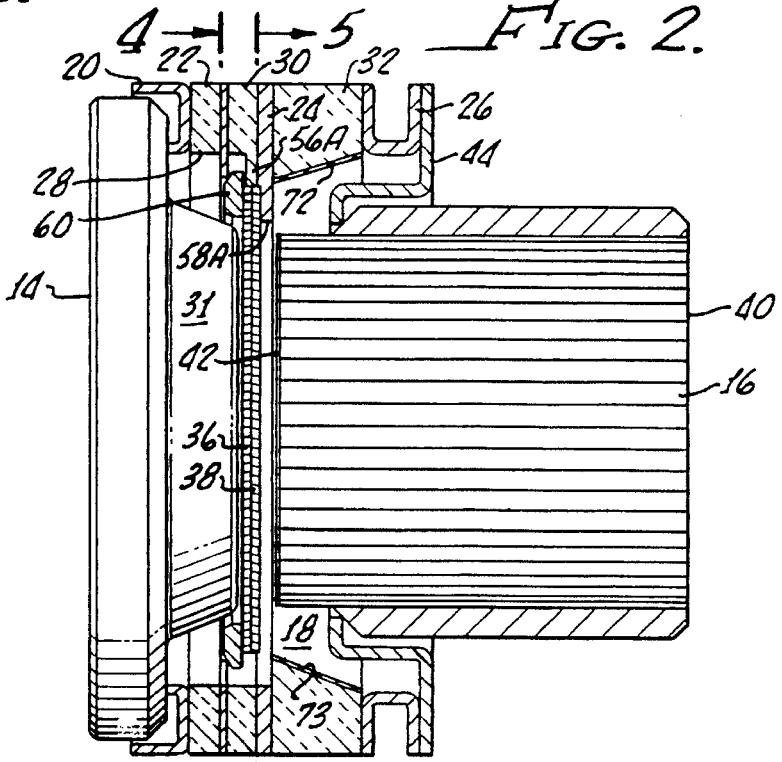
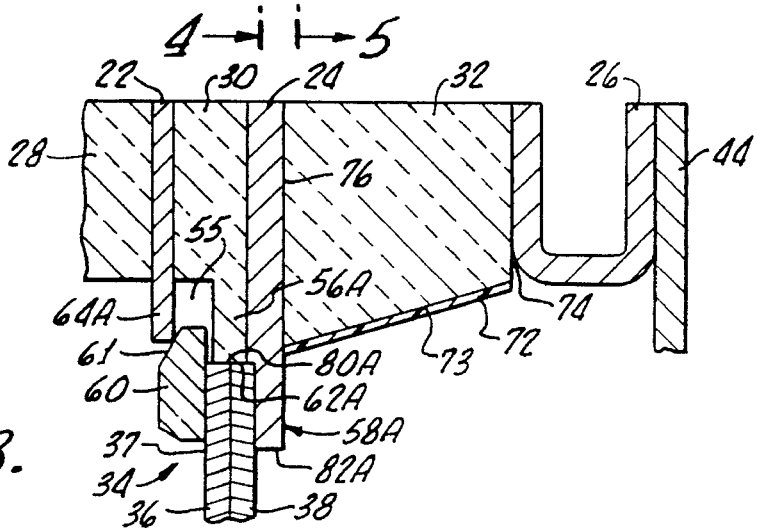
FIG. 3.

FIG. 6.
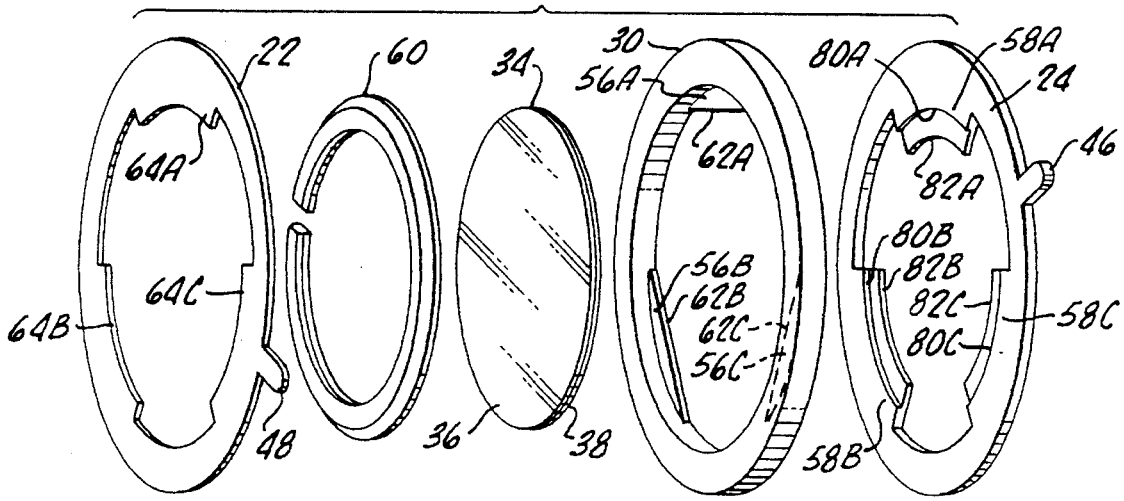
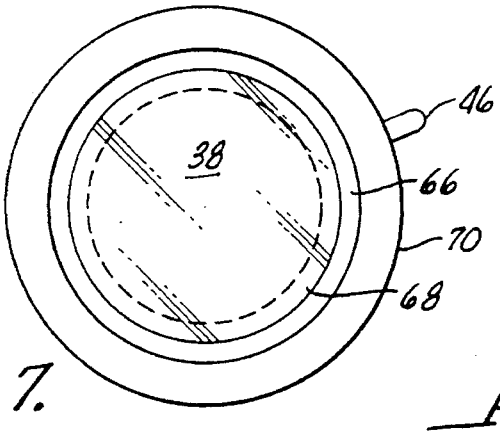
FIG. 7.
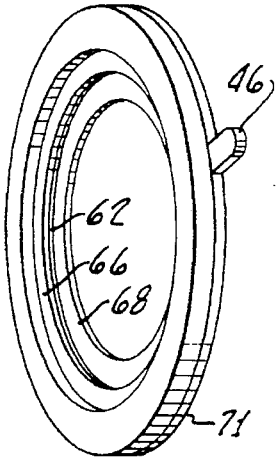
FIG. 8.
FIG. 9.
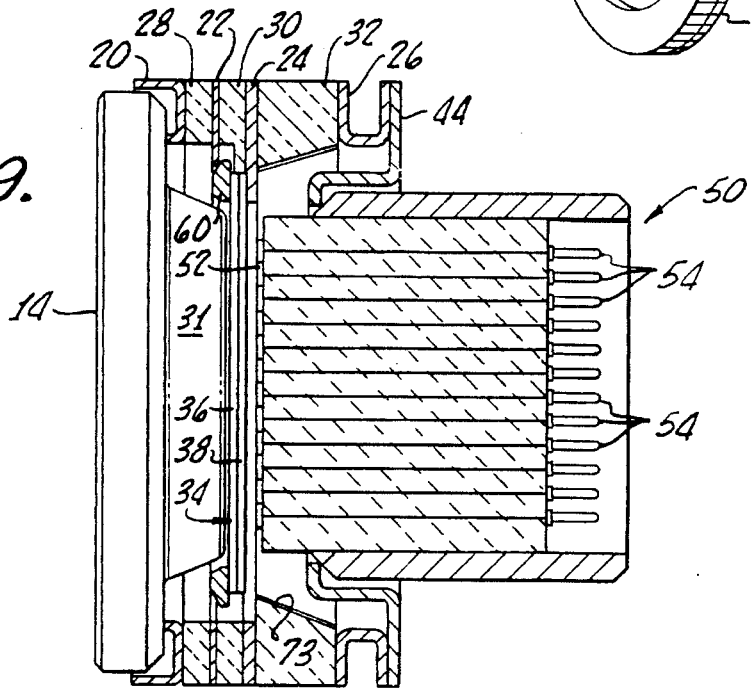

SHOCK RESISTANT CASCADED MICROCHANNEL PLATE ASSEMBLIES AND METHODS OF USE

FIELD OF THE INVENTION

The present invention relates in general to stacked or cascaded microchannel plates, and to methods of their use. More particularly, the present invention relates to such a high-output amplification tube of the photomultiplier type, or of the image intensifier type having a plurality of sequentially arranged, or cascaded, electron multiplier microchannel plates. Still more particularly, the present invention relates to a high output photomultiplier tube or image tube having cascaded microchannel plates radially constrained by an annular insulating ring. In another aspect of the present invention image intensifier tubes or photomultiplier tubes may include a tapered ceramic high voltage stand-off. The present invention also provides a method of making such tubes.

BACKGROUND OF THE INVENTION

A night vision system converts available low intensity ambient light to a visible image. These systems require some residual light, such as moon or star light, in which to operate. This light is generally rich in infrared radiation, which is invisible to the human eye. The ambient light is intensified by the night vision system to produce an output image which is visible to the human eye. The present generation of night vision systems use image intensification technology and, in particular, microchannel plates to amplify the low level of visible light and to render a visible image from the normally invisible infrared radiation. The image intensification process involves conversion of the received ambient light into electronic patterns and the subsequent projection of the electron patterns onto a receptor to produce an image visible to the eye. Typically, the receptor is a phosphorous screen which is viewed through a lens provided as an eyepiece.

Specific examples of microchannel plate amplification are found in the image intensifier tubes of the night vision devices commonly used by police departments and by the military for night time surveillance, and for weapon aiming. However, microchannel plates may also be used to produce an electric signal indicative of the light flux or intensity falling on a photocathode, and even upon particular parts of the photocathode. The resulting electrical signals can be used to drive a video display, for example, or be fed to a computer for processing of the information present in the electrical analog of the image.

In night vision devices, a photoelectrically responsive photocathode element is used to receive photons from a low-level image. Typically the low-level image is far too dim to view with unaided natural vision, or may only be illuminated by invisible infrared radiation. Radiation at such wavelengths is rich in the night-time sky. The photocathode produces a pattern of electrons (hereinafter referred to as "photoelectrons") which correspond with the pattern of photons from the low-level image. Through the use of electromagnetic fields, photoelectrons emitted from the photocathode are directed to the surface of a microchannel plate.

The pattern of photoelectrons is then introduced into a multitude of small channels (or microchannels) opening onto the surface of the plate which, by the secondary emission of electrons, produce a shower of electrons in a pattern corresponding to the low-level image. That is, the microchannel plate emits from its microchannels a proportional number of secondary emission electrons. These secondary emission electrons form an electron shower thereby amplifying the electrons produced by the photocathode in response to the initial low level image. The shower of electrons, at an intensity much above that produced by the photocathode, is then directed onto a phosphorescent screen. The phosphors of the screen produce a visible image in yellow-green light which replicates the low-level image. Understandably, because of the microchannel plate, the representative image is pixalized, or is a mosaic of the low-level image.

More particularly, the microchannel plate itself conventionally is formed from a bundle of very small cylindrical tubes which have been fused together into a parallel orientation. The bundle is then sliced to form the microchannel plate. These small cylindrical tubes of the bundle thus have their length arranged generally along the thickness of the microchannel plate. That is, the thickness of the bundle slice or plate is not very great in comparison to its size or lateral extent; however, the microchannels individually are very small so that their length along the thickness of the microchannel plate is still many times their diameter. Thus, a microchannel plate has the appearance of a thin plate with parallel opposite surfaces.

The microchannel plate may contain over a million microscopic tubes or channels communicating between the faces of the microchannel plate. Each tube forms a passageway or channel opening at its opposite ends on the opposite faces of the plate. Further, each tube is slightly angulated with respect to a perpendicular from the parallel opposite faces of the plate so that electrons approaching the plate perpendicularly can not simply pass through one of the many microchannels without interacting with the interior surfaces.

Internally the many channels of a microchannel plate are each defined by or are coated with a material having a high propensity to emit secondary electrons when an electron falls on the surface of the material. In addition, the opposite faces of the microchannel plate are conventionally provided with a conductive metallic electrode coating so that a high electrostatic potential can be applied across the plate. As previously indicated, an electrostatic potential is also applied between the photocathode and the microchannel plate to move the photoelectrons emitted by the photocathode to the microchannel plate. Consequently, electrons produced by the photocathode in response to photons from an external image travel to the microchannel plate in an electron pattern corresponding to the received pattern of low-level light. These electrons enter the channels of the microchannel plate and strike the angulated walls which are formed by the secondary electron emissive material. Thus, the secondary emission electrons in numbers proportional to the number of photoelectrons exit the channels of the microchannel plate to impinge on a phosphorescent screen. An electrostatic field between the microchannel plate and the phosphor screen drives the electrons to the screen producing an intensified mosaic image of the low-level scene.

A conventional microchannel plate is known in accord with U.S. Pat. No. 4,737,013, issued 12 Apr. 1988, to Richard E. Wilcox. This particular microchannel plate has an improved ratio of total end open area of the microchannels to the area of the plate. As a result, the photoelectrons are not as likely to miss one of the microchannels and impact on the surface of the microchannel plate to be bounced into another one of the microchannels. Such bounced photoelectrons, which then produce a number of secondary electrons from a part of the microchannel plate not aligned with the proper location of the photoelectron, provide noise or visual distortion in the image produced by the image intensifier. The image intensifier taught by the Wilcox patent solves this problem of the conventional technology.

Understandably, because the microchannel plate is supplying a considerable number of electrons which become a part of the electron shower on the phosphorescent screen, the plate is subject to an electrical current between the metallic electrodes on its opposite faces. This electrical current between the opposite faces of a microchannel plate is known as a "strip current" and a portion of this current "replenishes" the channel wall with electrons lost by the emission process. This strip current is a function of the electrical resistance of a microchannel plate.

Conventional image tubes and photomultiplier tubes are also known which make use of cascaded microchannel plates. That is, multiple microchannel plates are arranged in series so that the initial electrons from a photocathode, for example, fall into the first microchannel plate. From this first microchannel plate, the secondary electrons from the first plate fall into a second microchannel plate. This second microchannel plate adds its own secondary emission electrons, and provides an increasingly intense shower of electrons. This shower of electrons may flow to a third or subsequent microchannel plate for further multiplication. In this way a very high electron gain or amplification may be effected, with each initial electron falling into the first plate resulting in several hundred to several hundred thousand electrons flowing from the last microchannel plate of the cascade. This electron shower may flow to a phosphor screen for producing a visible image, or to a solid plate acting as the anode to collect charge. At the anode, the electron shower becomes a current in a conductor which may be processed to count initial electrons or, in the case of multiple electrodes, to generate an image electronically, for example.

With the conventional photomultiplier tubes using cascaded microchannel plates, the electrostatic potential is connected across the top electrode of the top microchannel plate and the bottom electrode of the last or bottom microchannel plate in the cascade, with reference to the direction of electron flow. Although the microchannel plates of such a conventional photomultiplier tube are in facial contact with one another and are electrically connected in series, they are not otherwise connected. Each of the microchannel plates in the cascade experiences the same strip current flow.

However, conventional technology using cascaded microchannel plates all suffer from the deficiency that some of the individual microchannel plates in a cascade of microchannel plates are generally not fully secured in the tube housing. While one or more of the cascaded microchannel plates may be secured to the housing of the tube, others of the cascaded microchannel plates are secured in position simply by their facial frictional contact and interface with adjacent microchannel plates in the cascade. While this construction of the conventional devices has been satisfactory for most of the image intensifier tubes and photomultiplier tubes of the conventional technology, greater uses for these devices have revealed use environments in which the unconstrained microchannel plates may be vibrated or jarred out of position. That is, if an image intensifier tube, for example, is subjected to an impact or jarring which shifts one or more of the cascade of microchannel plates relative to the other microchannel plates of the cascade, then the optimal operating relationship of these cascaded microchannel plates may be disturbed. The result may be a degradation of the image quality provided by the image tube or total failure of the microchannel plate cascade. The same applies with respect to photomultiplier tubes using cascaded microchannel plates.

Regardless of how many microchannel plates are used in an image intensifying apparatus, the amplified signal from the plates may be detected and displayed using a number of different techniques depending on the needs of the user. For example, rather than directing the electron shower from a microchannel plate to a phosphorescent screen to produce a visible image, the shower of electrons may be directed upon an anode in order to produce an electrical signal indicative of the light or other radiation flux incident on the photocathode. If a single anode is disposed at the location ordinarily occupied by the phosphorescent screen, this anode will provide a current indicative of the photons received from a low-level scene. If the single anode is pixelated into a grid or array of anodes, the various anode portions of the grid or array will provide individual electrical signals which are an electrical analog of the image mosaic. Consequently, these electrical signals can be used to drive a video display, for example, or be fed to a computer for processing of the information present in the electrical analog of the image. Such an array may be used as multichannel particle detectors, providing information regarding the occurrence of particle collisions or other events and presenting the data in the form of computer-generated video and graphical representations.

Alternatively, such a microchannel plate can be used as a "gain block" in a device having a free-space flow of electrons. That is, the microchannel plate provides a spatial output pattern of electrons which replicates an input pattern, and at a considerably higher electron density than the input pattern. Such a device is useful as a particle counter to detect high energy particle interactions which produce electrons.

No matter which display format is used, an electrostatic field must be maintained between the display electrode or anode and the microchannel plates. As previously discussed, it is this relatively strong field which accelerates the multiplied electrons from the plates to the display electrode where they impact the selected collector and are converted to provide the desired information. Conventional image intensifiers typically employ a non-conductive ring or stand-off placed between the output surface of the plate and the electrode to maintain the proper separation. However, in the intense electrical potential needed to accelerate the multiplied electrons to the display electrode, conventional stand-offs often fail and allow current to flow over adjacent surfaces. This, in turn, disrupts the electrostatic field between the microchannel plate and the display electrode destroying the image and rendering the apparatus inoperable.

Accordingly, it is an object of the present invention to provide an apparatus which secures cascaded microchannel plates in place preventing their radial dislocation.

It is another object of the present invention to provide photomultiplier tubes and image intensifier tubes incorporating securely fixed cascaded microchannel plates to prevent radial dislocation relative to the tube and to one another.

It is still another object of the present invention to provide particle amplification tubes having an improved capacity to resist disruptive electrical shorts in internally established electrostatic fields.

SUMMARY OF THE INVENTION

These and other objectives are achieved by the cascaded microchannel plate assembly of the present invention which, in a broad aspect, provides the lateral constraint necessary to maintain the proper alignment of the incorporated microchannel plates when subjected to shock and vibration. Generally the invention provides a cascaded microchannel plate assembly including a stacked pair of substantially circular microchannel plates in facial contact with one another. The stacked plates are aligned so as to define a congruent outer diameter. Also included in the microchannel plate assembly are an annular electrically conductive retaining ring and an annular electrically conductive support ring axially spaced apart by an insulating ring. Typically, the conductive rings are metallic or include a metallic component while the insulating ring is glass or ceramic in nature. Preferably the conductive retaining ring defines an inner diameter sufficient to pass the outer diameter delineated by the stacked microchannel plates. In contrast the conductive support ring defines an inner diameter less than the outer diameter circumscribed by the stacked microchannel plates. Together the pair of conductive rings and insulating ring cooperatively define a shoulder upon which the microchannel plates are seated. The insulating ring, interposed between the conductive rings defines an inner diameter section contacting each of the stacked microchannel plates to constrain any radial dislocation thereof.

In selected embodiments of the invention the inner diameter of the insulating ring is defined by a step which extends radially inward from the ring itself. As with other embodiments the inner diameter of the insulating ring defined by the step contacts the stacked microchannel plates to constrain any lateral movement and prevent the relative dislocation of the plates. In the preferred embodiment the step has an axial thickness less than that of the insulating ring. Moreover, the step may be circumferentially continuous or interrupted to provide a plurality of chords. The resulting chords are tangentially aligned with the outer diameter of the stacked microchannel plates and act to prevent their radial dislocation.

In another aspect, the present invention provides a vibration and shock resistant amplification tube including a cascaded microchannel plate assembly. The amplification tube may be of an image intensifier type or of a photomultiplier type. The shock resistant tube comprises a cylindrical chambered housing having an input window at a forward end for receiving photons. Preferably, the cylindrical chambered housing is formed of a plurality of stacked and interbonded ceramic and metallic rings. Within the chamber housing a photocathode is positioned to receive photons and responsively release photoelectrons in a shower corresponding to the pattern on the photons. Positioned to receive the photoelectrons is a cascaded microchannel plate assembly including a stacked pair of microchannel plates in facial contact with one another. As previously discussed the stacked pair of microchannel plates defines an outer diameter and is positioned by a pair of conductive rings axially spaced apart by an insulating ring. One conductive ring defines an inner diameter sufficient to pass the outer diameter of the microchannel plates, the other conductive ring defines an inner diameter less than the outer diameter of the microchannel plates. Accordingly, the pair of conductive rings cooperatively provide a shoulder upon which the microchannel plates are seated. The interposed insulating ring defines an inner diameter section contacting each one of the stacked pair of microchannel plates preventing radial dislocation. Optionally the inner diameter of the insulating ring is delineated by a step extending radially inward.

Yet another aspect of the present invention provides an image intensifier tube comprising interbonded ceramic and metallic rings which is resistant to disruptions of the established electrostatic fields. More particularly, the present invention provides amplification tubes of the image intensifier type or photomultiplier type having a ceramic stand-off with a tapered inner diameter interposed between the output surface of the microchannel plate and a display electrode. The tapered stand-off eliminates line of sight communication between the brazed surfaces of the conductive metallic rings used to establish the required electrostatic field thereby increasing the surface path length a charge must travel to short the field. In a preferred embodiment of the present invention, the tapered stand-off is coated with semiconductive green chromium oxide while the brazed interface between the stand-off and the conductive ring adjacent to the display electrode is radially recessed. This configuration, eliminating the straight path between the charged conductive surfaces, further reduces the likelihood of a short circuit. It is important to note that the tapered stand-offs may be used in conjunction with the shock resistant cascaded microchannel plate assembly of the present invention or with otherwise conventional image intensifiers.

Other objects, features, and advantages of the present invention will be apparent to those skilled in the art from a consideration of the following detailed description of preferred exemplary embodiments thereof taken in conjunction with the associated figures which will first be described briefly.

BRIEF DESCRIPTION OF THE DRAWINGS

FIG. 1 is a perspective view of the an image intensifier tube produced according to the teachings of the present invention;

FIG. 2 is an enlarged cross-sectional view of the image intensifier tube seen in FIG. 1;

FIG. 3 is a further enlarged cross-sectional portion of an amplification tube showing an incorporated microchannel plate assembly and tapered stand-off in accordance with the present invention;

FIG. 6 is an exploded view of a microchannel plate assembly of the present invention;

FIG. 7 is a plan view of an amplification tube similar to FIG. 5, but showing an insulation ring having a circumferentially continuous step;

FIG. 8 is a perspective view of an insulation ring having a circumferentially continuous step;

FIG. 9 is a partial cross-sectional view of an amplification tube of the photomultiplier type in accordance with the present invention.

DETAILED DESCRIPTION OF THE INVENTION

Figure 4:
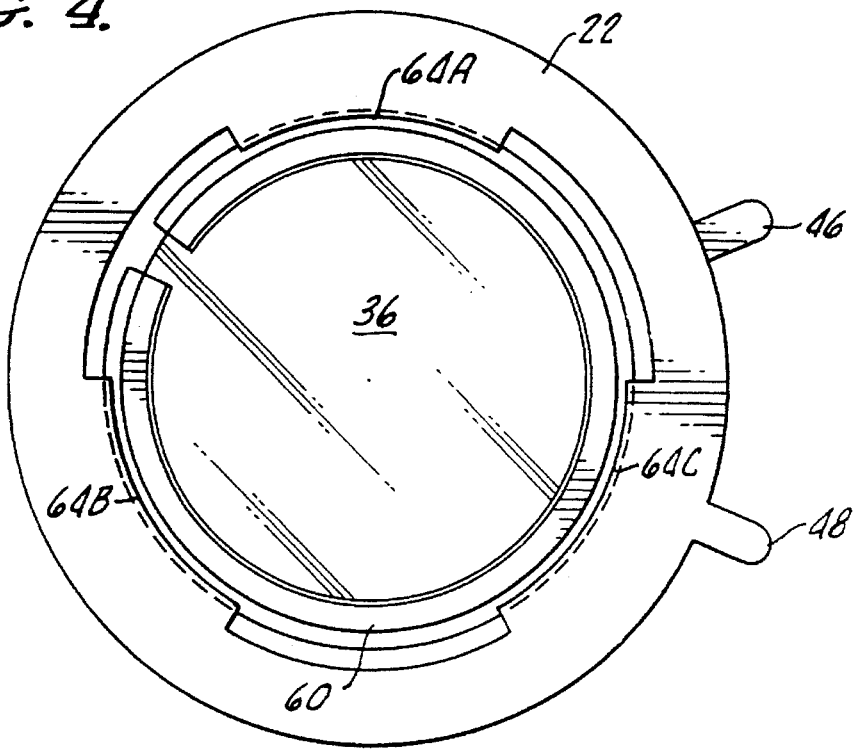
FIG. 4 is cross-sectional portion of an image intensifier tube taken at line 4–4 of FIG. 2.

While the present invention may be embodied in many different forms, disclosed herein are specific illustrative embodiments thereof that exemplify the principles of the invention. It should be emphasized that the present invention is not limited to the specific embodiments illustrated.

Turning now to the Figures, FIGS. 1 to 3 in conjunction with one another show an image intensifier tube 10 produced in accordance with the present invention. Image intensifier tube 10 includes a cylindrical tubular body 12, which is closed at opposite ends by a front light-receiving window 14, and by a rear fiber-optic image output window 16. Windows 14 and 16 are sealingly engaged with tubular body 12, so that an interior chamber 18 can be maintained at a vacuum relative to ambient. Generally, cylindrical tubular body 12 is made up of annular electrically conductive rings 20, 22, 24, 26 sealingly interbonded with interposed insulation rings 28, 30, 32. Electrically conductive rings 20, 22, 24, 26 are axially spaced apart by insulation rings 28, 30, 32 which keeps them electrically insulated from one another. End rings 20 and 26 are sealingly attached to the respective windows 14 and 16.

Those skilled in the pertinent arts will appreciate that the conductive rings 20, 22, 24, 26 are electrically connected to an electrostatic power supply (not shown) which is effective during operation of the image intensifier tube 10. The electrostatic power supply acts to establish electrostatic fields along the length of tubular body 12 between the individual conductive rings. Electrostatic fields are established between conductive rings 20 and 22, between 22 and 24 and between 24 and 26 with the higher numbered ring always being the anode. That is, the electrostatic potentials established along tubular body 12 are most negative at conductive ring 20 and most positive at conductive ring 26. Projecting contacts 46, 48, on conductive rings 22 and 24 respectively, provide for the easy connection of the external power source. The electrostatic fields act to accelerate the electrons used to amplify the low level image received by the image intensifier.

As shown in detail in FIG. 2, front window 14 carries on its rear surface within chamber 18 a photocathode 31. Photocathode 31 is responsive to photons of light entering through front window 14 to release electrons (hereinafter referred to as photoelectrons). Typically, photocathode 31 is a circular disk having a predetermined construction and mounted in a conventional manner. Suitable photocathode materials are generally semi-conductors such as cesium, antimony or gallium arsenide with a preferred substrate comprising a sodium-potassium cesium antimony compound, commercially sold under the designation S-20. Those ordinarily skilled in the pertinent arts will recognize that the light entering front window 14 will be focused upon photocathode 31 to produce an image. This image may be too dim to be viewed with the natural vision, and may be entirely or partially of infrared light which is invisible to the human eye. Alternatively, photocathode 31 may be responsive to ultraviolet light, which is also invisible to the human eye, to release photoelectrons.

In any case, photocathode 31 will respond to the impinging photons by releasing a shower of photoelectrons in a pattern replicating the received image. Photoelectrons emitted from photocathode 31 are accelerated through an electric field of predetermined intensity established between conductive ring 20 and conductive retaining ring 22. Typically, the electrostatic potential will be the order of >0 to 800 volts and more particularly approximately 200 volts to impart the desired energy to the photoelectrons. Upon acceleration and passing through the electrostatic field, the photoelectrons impinge upon a cascade 34 of two stacked microchannel plates 36, 38. Accelerated by a second electrostatic field established between conductive retaining ring 22 and conductive support ring 24, the photoelectrons are amplified as known in the art to produce a proportionately larger number of secondary emission electrons upon passage through microchannel plates 36, 38. This second electrostatic field, across cascade 34 of microchannel plates 36, 38, is between 600 and 2000 volts and is typically about 800 volts per microchannel plate. The amplified shower of secondary emission electrons exiting microchannel plate 38 are accelerated by yet another electrostatic field established between conductive support ring 24 and conductive ring 26 in contact with display electrode or anode 44. Usually this field is established using a bias voltage on the order of 3,000 to 8,000 volts and more preferably on the order of 5,000 volts to impart the desired energy to the secondary emission electrons.

More particularly, the shower of photoelectrons falling into various channels of the microchannel plate 36 causes this plate to liberate a proportionate number of secondary emission electrons. As these secondary emission electrons travel through the cascade 34 of microchannel plates 36, 38 the photoelectrons and secondary emission electrons initially liberated further interact with the successive microchannel plate 38 in cascade 34 so that still additional secondary emission electrons are released. While the embodiments illustrated show a cascade of two microchannel plates, it is important to note that three or more plates may be used in accordance with the present invention. In any case the microchannel plates 36, 38 originate the secondary emission electrons as was mentioned above. The electrostatic potentials experienced by microchannel plates 36, 38 are proportional to the resistance of microchannel plates 36, 38. As a result, the individual microchannel plates in cascade 34 act as a voltage divider, so that each carries substantially the same strip current.

Because of the applied electrostatic field the accelerated shower of secondary emission electrons, now several orders of magnitude more intense than the initial shower of photoelectrons but still replicating the image focused on photocathode 31, falls on phosphor screen 42 at the front face of fiber optic output window 16 to produce a visible image in phosphor emitted yellow-green light. Phosphor screen 42 is in electrically conductive contact with anode 44. It should be apparent that phosphor screen 42 acts as a means for converting the electron pattern generated by photocathode 31 to a visible light image of the initially received low level image. Following conversion to a visible light image, the information presented on phosphor screen 42 passes through fiber optic output window 16 to rear surface 40 providing an observer with the desired image. Due to the discreet passage construction of the microchannel plates 36, 38 as well as the discreet optical fiber construction of the fiber optic output window 16, the image available at surface 40 is a mosaic of the image focused on the photocathode 31.

Yet, as discussed above, the data output from the amplification tube is not always converted to a visible image. For example, as seen in FIG. 9 the present invention may be used to provide an amplification tube of the photomultiplier type. Because many of the features of the embodiment seen in FIG. 9 are the same as or are analogous to those depicted and described in connection with FIGS. 1–3, the same reference numeral is used in connection with this second embodiment to indicate the same feature or features which are analogous in structure or function. The photomultiplier tube 10 includes a tubular body 12 closed at one of its two opposite ends by an input window 14. At the other of its opposite ends, the body 12 is closed by an insulative multi-conductor electrical connector assembly 50. FIG. 9 further depicts inner surface 52 of connector assembly 50 within chamber 18. On this inner surface an array of individual electrodes (anodes) is presented to the amplified shower of secondary emission electrons emerging from the rear face of the cascaded microchannel plates 36, 38. Each of the anodes is individually electrically connected through connector 50 to a respective connector pin 54 presented outwardly on tubular body 12.

Because a certain level of electrons falls on each element (pixel) of the array of anodes, these anodes will have a respective imposed charge or current flow. The various current flows from the anodes is available externally of the photomultiplier tube 10 by electrical connection to the pins 54. These electrical voltage or current flow levels at the pins 54 represent, in electrical form, a mosaic of the image focused on the photocathode 31. Depending on the size of the individual anodes this mosaic may have a blocky form with resolution sufficient only to reveal gross features of the image, or may with a large number of sufficiently small anodes present a fine mosaic with small-feature resolution. As explained above, this electrical analog image mosaic may be reconstructed by use of video equipment or may be processed with a computer for storage or viewing.

Regardless of the display format selected, the amplification tubes of the present invention securely position stacked microchannel plates 36, 38 to prevent any undesirable lateral dislocation. As shown in FIGS. 2 and 9 and illustrated more clearly in FIGS. 3 and 6, stacked microchannel plates 36, 38 are positioned between conductive support ring 24 and conductive retaining ring 22. More specifically, FIGS. 3 and 6 reveal that cascade 34 of microchannel plates 36, 38 is seated on interrupted inner flange portions 58A, 58B, 58C of conductive support ring 24. That is, support ring 24 includes inner flange portions 58A, 58B, 58C and these flange portions define a ledge so that axially disposed shoulders 82A, 82B, 82C surrounded by radially disposed steps 80A, 80B, 80C are provided. Microchannel plate 38 is seated upon shoulders 82A, 82B, 82C and positioned radially relative to amplification tube 10 by steps 80A, 80B, 80C. Microchannel plate 36 is stacked on the microchannel plate 38 so that facial metallic electrode coatings (not shown) of each microchannel plate 36, 38 are in physically contacting and electrically conducting relationship to form cascade 34.

Figure 5:
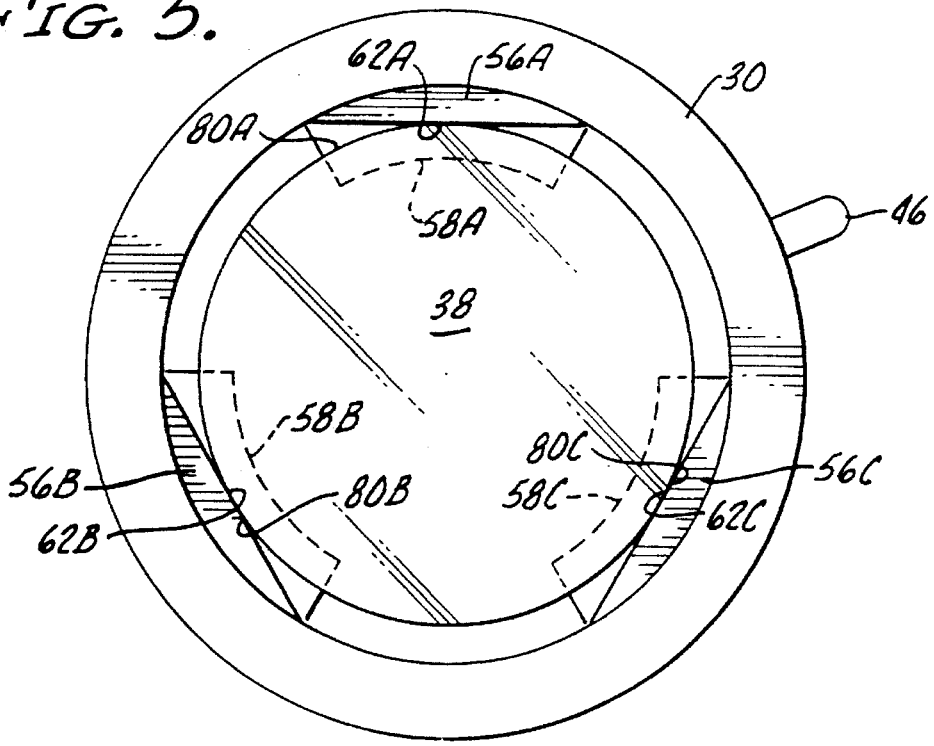
FIG. 5 is cross-sectional portion of an image intensifier tube taken at line 5–5 of FIG. 2.

As is shown clearly in FIG. 5 and in the exploded microchannel plate assembly of FIG. 6, insulating ring 30 includes interrupted steps 56A, 56B, 56C extending radially inward to provide insulating ring inner diameter surfaces 62A, 62B, 62C. During manufacture, insulating ring 30 is sealingly interbonded to conductive support ring 24 under axial compression. When seated upon shoulders 82A, 82B, 82C of conductive support ring 24, cascade 34 of microchannel plates 36, 38 define a congruent outer diameter. Insulating ring inner diameter surfaces 62A, 62B, 62C define a plurality of chords which are tangentially aligned with the outer diameter of stacked microchannel plates 36, 38. Accordingly, insulating ring inner diameter surfaces 62A, 62B, 62C tangentially contact both stacked microchannel plates 36, 38 thereby preventing any lateral dislocation of cascade 34. The points of tangential contact exhibit the same diameter as that circumscribed by step 80 on conductive support ring 24. In the embodiment shown, inner diameter surfaces 62A, 62B, 62C provide three points of tangential contact with cascade 34. Of course those skilled in the art will appreciate that, depending on the number of interruptions in step 56, any number of tangential chords and, correspondingly, any number of tangential contact points could be provided to prevent radial displacement of microchannel plates 36, 38.

Sealingly interbonded to insulation ring 30 on the side axially opposite conductive support ring 24, is conductive retaining ring 22. As with conductive support ring 24, annular conductive retaining ring 22 is circumferentially interrupted to define retaining shoulders 64A, 64B, 64C extending radially inward. Typically, conductive retaining ring 22 is formed of, or includes, a metal or metallic alloy and is interbonded to insulating ring 30 using brazing, adhesives or other bonding techniques known in the art. Taken together, conductive retaining ring 22, insulating ring 30 and conductive support ring 24 cooperatively define a support structure for the vibration resistant seating of microchannel plate cascade 34. Moreover, as previously discussed, interposed insulating ring 30 prevents the direct transmission of electrical current applied to conductive retaining ring 22 to conductive support ring 24 thereby providing for establishment of the required electrostatic charge across microchannel plates 36, 38.

In a preferred embodiment a resilient spring snap ring 60 having a chamfered radially outer surface is disposed axially between radially inner portions of retaining shoulders 64A, 64B, 64C and the forward surface 37 of microchannel plate 36 of cascade 34. The resilient spring snap ring 60 is effective because wedging action from the chamfered surface 61 in cooperation with the radially inner portions of retaining shoulders 64A, 64B, 64C acts to apply an axial clamping force on stacked microchannel plates 36, 38. In turn microchannel plates 36, 38 are axially retained by shoulders 82A, 82B, 82C of conductive support ring 24. The chamfered surface of snap ring 60 can slide under, and contact conducting retaining ring 22, due to the radial cavity 55 defined by the relative differences in axial thickness of interrupted steps 56A, 56B, 56C and insulating ring 30. That is, because insulating ring 30 is axially thicker than interrupted steps 56A, 56B, 56C, conductive retaining ring 22 and conductive support ring 24 are axially separated by an amount which allows snap ring 60 to slip under retaining ring 22 without contacting steps 56A, 56B, 56C. The imposed axial clamping force, combined with the tangential contact of inner diameter surfaces 62A, 62B, 62C of insulating ring 30, is sufficient to retain cascade 34 of microchannel plates 36, 38 in the illustrated preferred position relative to one another and relative to tubular body 12. This preferred relative position of microchannel plates 36, 38 is maintained despite use conditions subjecting the microchannel plate assembly to unintended vibration or sharp impact forces.

An alternative embodiment of the present invention having a circumferentially continuous step on insulating ring 70 is shown in FIGS. 7 and 8. More particularly, FIG. 7 shows a cross sectional view of an amplification tube substantially similar to that of FIG. 5. However, in the embodiment of the invention shown in FIG. 7, step 66 of insulating ring 70 is not interrupted but is continuous about the entire circumference of the ring. Similarly, inner flange portion 68 of conductive support ring 71 is not interrupted but is continuous about the entire circumference of the annular ring. Shown more clearly in FIG. 8, continuous step 66 of insulating ring 70 defines an inner diameter surface 62 which is used to prevent the radial dislocation of cascaded microchannel plates (not shown) seated on continuous inner flange portion 68 of conductive support ring 71. That is, continuous inner flange portion 68 and inner diameter surface 62 of continuous step 66 act in concert as previously described for inner flange portions 58A, 58B, 58C and inner diameter surfaces 62A, 62B, 62C. However, unlike the embodiments previously discussed, there are not a discrete number of contact points used to radially constrain cascaded microchannel plates 36, 38. Rather, the outer diameter defined by microchannel plates 36, 38 is continuously contacted by inner diameter surface 62 thereby retaining microchannel plate cascade 34 in its preferred position. In such embodiments the other components of the microchannel plate assembly or amplification tube interact as previously described. Further, it is important to note that a continuous step 66 may be used with interrupted or continuous flange portions while continuous inner flange portion 68 may be used with either interrupted or continuous steps.

Yet another aspect of the present invention is illustrated in FIGS. 4 and 8 and shown more clearly in FIG. 3. Specifically, an insulating ring or stand-off 32 is tapered to provide an amplification tube exhibiting a lower probability of experiencing a disabling short circuit. As seen in the figures, the tapered or conical inner diameter 73 of stand-off 32 provides a greater path length between conductive support ring 24 and conductive ring 26 which is in electrically conductive contact with anode 44. While this aspect of the present invention is illustrated in amplification tubes having cascaded microchannel plates, it is important to note that tapered stand-offs may be used with otherwise conventional amplification tubes. That is, tapered stand-off 32 may be incorporated in amplification tubes having only one microchannel plate to reduce the possibilities of a short circuit.

Typically the potential between conductive support ring 24 and conductive ring 26 is between 3,000 and 8,000 volts and preferably on the order of 6,000 volts. While this high potential is necessary to accelerate the multiplied electrons from the microchannel plates to the display electrode and detector assembly, maintaining the electrostatic charge often leads to short circuits through conventional vertical stand-offs having line of sight pathways between the interface of insulating ring 32 and conductive rings 24, 26. This particularly true when the brazing material used to bond the stand-off to the conductive rings extends into a line of sight pathway. In such cases, the electric charge frequently defines a path of least resistance along the distance between the brazing rather than maintaining the desired field between anode 44 and conductive support ring 24 in contact with microchannel plate 38. As discussed previously this leads to a short which renders the amplification tube unworkable.

Preferably tapered stand-off 32 is formed of a ceramic or ceramic composite material and is covered with a chromium oxide semi-conductor layer 72 to eliminate electrical charge build up on the surface of the ceramic material. The tapered configuration of stand-off 32 removes any line of sight pathways between the interbonding brazing layers. More particularly conductive brazing layer 76, at the interface of conductive support ring 24 and stand-off 32 terminates at the inner diameter of stand-off 32. Conversely, conductive brazing layer 74 and conductive ring 26 are radially recessed with respect to the inner diameter of tapered stand-off 32. This radial recession, in combination with the tapered configuration of stand-off 32, eliminates any line of sight surface communication between the conductive rings and substantially increases the amount of voltage required to short the electrostatic field. Accordingly, the required electrostatic field can be maintained between the rear surface of microchannel plate 38 and anode 44 with a lower chance of inadvertently short circuiting amplification tube 10.

Those skilled in the art will further appreciate that the present invention may be embodied in other specific forms without departing from the spirit or central attributes thereof. In that the foregoing description of the present invention discloses only exemplary embodiments thereof, it is to be understood that other variations are recognized as being within the scope of the present invention. Accordingly, the present invention is not limited to the particular embodiments which have been described in detail herein. Rather, reference should be made to the appended claims to define the scope and content of the present invention.

What is claimed is:

1. A shock resistant cascaded microchannel plate assembly comprising:

a stacked pair of microchannel plates in facial contact with one another, said stacked pair of microchannel plates defining an outer diameter; and an annular, electrically conductive retaining ring and an annular electrically conductive support ring axially spaced apart by an insulating ring, said electrically conductive retaining ring defining an inner diameter sufficient to pass the outer diameter of the microchannel plates, and said electrically conductive support ring defining an inner diameter less than the outer diameter of the microchannel plates to cooperatively define a shoulder upon which the microchannel plates are seated, said insulating ring defining an inner diameter surface confronting each one of said stacked pair of microchannel plates to constrain radial dislocation thereof.

2. The cascaded microchannel plate assembly of claim 1 wherein said insulating ring is fabricated from material selected from the group consisting of ceramic and ceramic composites.

3. The cascaded microchannel plate assembly of claim 1 wherein said electrically conductive support ring and said electrically conductive retaining ring include a material selected from the group consisting of metal and metallic alloys.

4. The cascaded microchannel plate assembly of claim 1 wherein said inner diameter of said insulating ring is defined by a step, said step extending radially inward and having an axial thickness less than the axial thickness of said insulating ring.

5. The cascaded microchannel plate assembly of claim 4 wherein said step of said insulating ring is circumferentially continuous.

6. The cascaded microchannel plate assembly of claim 4 wherein said step of said insulating ring is interrupted to define a plurality of chords tangentially aligned with said outer diameter of said pair of stacked microchannel plates.

7. The cascaded microchannel plate assembly of claim 6 wherein said step of said insulating ring is interrupted three times to define three symmetrically spaced chords.

8. The cascaded microchannel plate assembly of claim 1 further comprising a snap ring positioned adjacent to said stacked microchannel plates, said snap ring releasably engaged by said retaining ring to urge said stacked pair of microchannel plates toward said support ring.

9. An image intensifier tube including the cascaded microchannel plate assembly according to claim 1.

10. A photomultiplier tube including the cascaded microchannel plate assembly according to claim 1.

11. A vibration and shock resistant tube having a cascaded microchannel plate assembly resistant to the relative movement of the cascaded microchannel plates, said tube comprising:

a chambered housing having a cylindrical body and an input window at a forward end thereof for receiving photons;

a photocathode within said chambered housing for receiving said photons and responsively releasing photoelectrons in a shower having a pattern replicating said photons;

a cascaded microchannel plate assembly for receiving said photoelectrons and responsively releasing proportionate secondary emission electrons to produce an intensified electron shower in a pattern replicating said photons, said cascaded microchannel plate assembly including a stacked pair of microchannel plates in facial contact with one another, said stacked pair of microchannel plates defining an outer diameter, a pair of conductive rings axially spaced apart by an insulating ring, one conductive ring defining an inner diameter sufficient to pass the outer diameter of the of the microchannel plates, the other conductive ring defining an inner diameter less than the outer diameter of the microchannel plates, said pair of conductive rings cooperatively defining a shoulder upon which the microchannel plates are seated, said insulating ring defining an inner diameter surface radially confronting each one of said stacked pair of microchannel plates to constrain radial dislocation thereof.

12. The vibration and shock resistant tube of claim 11 wherein said tube is an image intensifier type and said photons are focused to form an image, said housing including a transparent rear image window closing said chamber, said intensified electron shower replicating said image, and said tube further including a phosphor screen within said chamber and receiving said electron shower to provide a visible image, said phosphor screen being associated with a forward surface of said rear image window to transmit said visible image outwardly of said image intensifier tube.

13. The vibration and shock resistant image intensifier tube of claim 12 wherein said rear image window is of fiber optic construction.

14. The vibration and shock resistant image intensifier tube of claim 12 wherein said rear image window is of image-inverting fiber optic construction.

15. The vibration and shock resistant tube of claim 11 wherein said tube is a photomultiplier type, and said tube includes a rear connector portion closing said chamber and carrying on a forward surface thereof within said chamber at least a single anode receiving said intensified electron shower to provide an electrical signal in response thereto.

16. The vibration and shock resistant photomultiplier tube of claim 15 wherein said connector portion includes an electrical connector pin outwardly disposed on said tube and electrically connecting with said at least one anode to deliver said electrical signal.

17. The vibration and shock resistant tube of claim 11 wherein said insulating rings are fabricated from material selected from the group consisting of ceramic and ceramic composites.

18. The vibration and shock resistant tube of claim 11 wherein said electrically conductive rings include a material selected from the group consisting of metal and metallic alloys.

19. The vibration and shock resistant tube of claim 11 wherein said inner diameter of said insulating ring is defined by a step, said step extending radially inward from and having an axial thickness less than that of said insulating ring.

20. The cascaded microchannel plate assembly of claim 19 wherein said step of said insulating ring is circumferentially continuous.

21. The vibration and shock resistant tube of claim 19 wherein said step of said insulating ring is interrupted to define a plurality of chords tangentially aligned with said outer diameter of said pair of stacked microchannel plates.

22. The vibration and shock resistant tube of claim 11 wherein said cylindrical body is formed of a plurality of stacked and sealingly interbonded alternating insulating rings and conductive rings.

23. A particle amplification tube with enhanced resistance to disruptive short circuits, said tube comprising:

a chambered housing having a cylindrical body and an input window at a forward end thereof for receiving photons;

a photocathode within said chambered housing for receiving said photons and responsively releasing photoelectrons in a shower having a pattern replicating said photons;

at least one microchannel plate having an input face for receiving said photoelectrons and an output face for responsively releasing proportionate secondary emission electrons to produce an intensified electron shower in a pattern replicating said photons;

a display electrode positioned to receive said secondary emission electrons to provide an enhanced image, said display electrode associated with a forward surface of a rear image window to transmit said enhanced image outwardly from said tube, a first conductive ring in electrical contact with said output face of said microchannel plate, and a second conductive ring in electrical contact with said display electrode, an insulating ring interposed between said conductive rings, said insulating ring having a tapered inner diameter surface.

24. The particle amplification tube of claim 23 wherein said tube is an image intensifier type and said photons are focused to form an image, said housing including a transparent rear image window closing said chamber, said intensified electron shower replicating said image, and said tube further including a phosphor screen in electrical contact with said display electrode and receiving said electron shower to provide a visible image, said phosphor screen being associated with a forward surface of said rear image window to transmit said visible image outwardly of said image intensifier tube.

25. The image intensifier tube of claim 24 wherein said rear image window is of fiber optic construction.

26. The particle amplification tube of claim 23 wherein said tube is a photomultiplier type, and said tube includes a rear connector portion closing said chamber and carrying on a forward surface thereof within said chamber at least a single display electrode receiving said intensified electron shower to provide an electrical signal in response thereto.

27. The photomultiplier tube of claim 26 wherein said connector portion includes an electrical connector pin outwardly disposed on said tube and electrically connecting with said at least one display electrode to deliver said electrical signal.

28. The particle amplification tube of claim 23 wherein said tapered insulating ring is fabricated from material selected from the group consisting of ceramic and ceramic composites.

29. The particle amplification tube of claim 28 wherein said tapered insulating ring is coated with green oxide.

30. The particle amplification tube of claim 23 wherein the electrically conductive rings include a material selected from the group consisting of metal and metallic alloys.

31. The particle amplification tube of claim 23 wherein said cylindrical body is formed of a plurality of stacked and sealingly interbonded alternating insulating rings and conductive rings.

* * * * *